US005657992A

United States Patent [19]

Bellizzi

[11] Patent Number: 5,657,992

[45] Date of Patent: Aug. 19, 1997

[54] ENTERTAINMENT DEVICE AND METHOD FOR DEVELOPING ACTING, THINKING, WRITING AND PUBLIC SPEAKING ABILITY

[76] Inventor: Anthony Bellizzi, 90-21 Springfield Blvd., Queens Village, N.Y. 11428

[21] Appl. No.: 684,221

[22] Filed: Jul. 19, 1996

[51] Int. Cl.[6] ..... A63F 3/00

[52] U.S. Cl. ..... 273/273; 273/299; 434/156

[58] Field of Search ..... 273/236, 272, 273/273, 292, 299, 300, 301, 302, 308; 434/156

[56] References Cited

U.S. PATENT DOCUMENTS

| | | | |
|---|---|---|---|
| 170,381 | 11/1875 | Landis | 273/300 |
| 1,104,724 | 7/1914 | Alsruhe | 273/300 |
| 1,323,713 | 12/1919 | Meriwether | 273/300 |
| 1,699,132 | 1/1929 | Buchanan . | |
| 1,716,069 | 6/1929 | Loayza . | |
| 1,791,708 | 2/1931 | Bridges . | |
| 2,099,611 | 11/1937 | Levoy | 273/299 |
| 3,779,557 | 12/1973 | Kritzberg et al. . | |
| 4,445,869 | 5/1984 | Wasserman | 434/156 |
| 4,684,135 | 8/1987 | Bouchal | 273/269 |
| 4,944,519 | 7/1990 | Canela | 273/273 X |
| 5,100,154 | 3/1992 | Mullins | 273/429 |
| 5,401,032 | 3/1995 | Barnhart, et al. | 273/293 |
| 5,435,568 | 7/1995 | Black | 273/308 X |
| 5,474,456 | 12/1995 | Paiken | 434/156 |
| 5,568,924 | 10/1996 | Katsuren | 273/299 X |

FOREIGN PATENT DOCUMENTS

| | | | |
|---|---|---|---|
| 273299 | 12/1907 | United Kingdom . | |
| 2091112 | 7/1982 | United Kingdom | 273/299 |

*Primary Examiner*—William E. Stoll
*Attorney, Agent, or Firm*—Mark E. Bender

[57] ABSTRACT

A method and apparatus for entertaining a group of players is provided in which a director distributes playing cards and scenario cards from a plurality of decks of game cards, a game board is provided, and players attempt to creatively and amusingly play their cards to produce a story line on which the director has arbitrary cutting authority. The method an apparatus of the present invention provide for entertainment and education of players and the game familiarizes players with current art, literature, drama, comedy, films and celebrities. The method and apparatus of the present invention demonstrate and elicit creative thinking and mental agility in the players.

10 Claims, 3 Drawing Sheets

ENTERTAINMENT DEVICE AND METHOD FOR DEVELOPING ACTING, THINKING, WRITING AND PUBLIC SPEAKING ABILITY

BACKGROUND OF THE INVENTION

The present invention comprises an entertainment apparatus and method entertaining a group of players and for developing useful human skills including, but without being limited to, the game player's ability to generate original writings for movie and television productions, or scripts to comprise literary works. At the same time, the present invention addresses developing the user's acting, improvisational and public speaking abilities.

Until now, games which involved story telling have required players to tell their own story or to assemble their own story by various means. But in none of the prior art has there been a game in which players take turns in creatively stringing together phrases inscribed on cards held in their hands by taking turns playing the cards, one-at-a-time, to amuse and teach themselves mental quick-response and creative thinking skills. Also, none of the prior art games has a director who functions in the manner of the present invention. The director in the present invention not only selects what kind of story or scenario the players are to develop, but also selects the deck or decks of cards from which individual players will be dealt cards to be played.

In the prior art, for instance, U.S. Pat. No 4,684,135 to Bouchal discloses a story telling game. It includes the use of cards, dice and wild cards. Provides cards with graphic images and dice—but Bouchal '135 does not utilize judgment or selectivity by a director or player-group of the appropriateness of play or directorial arbitrary authority as does the present invention.

U.S. Pat. No. 1,699,132 to Buchanan is a movie game with a director and a scheme for the players to decide upon the rules of playing the game. It provides random plot-contriving and schooling of the players in the art or science of story or play writing, with players enabled to weave a story from a game having general structural divisions of a story, each division having a plurality of otherwise unrelated descriptive matters whereby a player or players may be enabled to weave a story from a chance selection of any one of the descriptive matters from each and all of the divisions when collected in their sequential order.

Buchanan '132 differs from the present invention in the following ways. Buchanan '132 provides for a pre-printed game board which imposes story elements which game players view at all times. In the present invention, however, dialog cards with dialog phrases inscribed thereon are held in players' hands to be played as desired without forewarning to other players. Further, the nature of the story to be developed in Buchanan '132 may be generally indeterminate at the start of the game, but is necessarily defined by the pre-written story elements which are already displayed on the game board at the start of play.

Furthermore, play of the game in Buchanan '132 is completely random, and not player-selected or supervised by a director with whom the players can interact, as in the present invention. Buchanan '132 does not provide for players to select the dialog elements to be played as in the present invention. Instead, Buchanan '132 provides for this to happen randomly, thus strongly distinguishing Buchanan '132 from the player selection of dialog elements to be added to the game of the present invention. Further, the director in Buchanan '132 is chosen randomly and not at the beginning of play as in the present invention. The director of Buchanan '132 has no game-determining arbitrary authority as does the director of the present invention.

U.S. Pat. No. 5,100,154 to Mullins discloses a timed group writing game with random characterizations. Several short stories are composed and a timer is used to limit writing time. Sets of cards provide character profiles for each player's main character. Participants compose the beginnings of a short story in the genre chosen, about a character described by the character cards and write as much as possible in a set time limit. At the end of the time limit, stories are passed to the player at the left of the writer.

U.S. Pat. No. 1,791,708 to Bridges is a children's' card game inculcating safety specifically. It uses inscribed cards to generate safety slogans.

U.S. Pat. No. 5,401,032 to Barnhart, et al provides a game having a number of cards on which a story is written. Certain elements of the story are obscured by chromatic camouflage. A decoder having a chromatic filter is used to view the obscured indicia. The game involves inferring words and meaning from pictures provided along with text, and does not involve creating a story line by the players.

U.S. Pat. No. 4,445,869 to Wasserman provides a teaching method and apparatus for writing using decks of cards including "who" "where" and "how" cards among other kinds of decks of cards in an organizational plan for writing. The teaching method includes several different cards having key words such as WHO, WHAT, WHERE, WHY and HOW printed at the top. The individual to be taught picks a topic and chooses the first card with the word WHO on it. The individual then decides who the characters are going to be in his story and writes them on the card. Thus, Wasserman '869 uses "who" "where" and "how" cards but does so very differently from the present invention which merely uses them to set the scene for the entire group of game players simultaneously—rather than as a stimulus for individual character generation as in Wasserman '869.

U.S. Pat. No. 3,779,557 to Kritzberg provides a psychological therapy game played by a patient and a therapist. Its purpose and plan is to evoke thoughts and behaviors from the patient which the therapist can observe and evaluate so as to diagnose and to treat. It is not a game for a group of players, nor is it for amusement, U.S. Pat. No. 1,716,069 to Loayza provides a tile or card game to work out or tell a story—either historical or fictional—but which story already exists and is merely being retold. The story is not being developed from a dangling dialog end as in the present invention with the outcome of the story amusingly in question at every moment.

British Patent 273,279 dated 1st Oct., 1907 provides for a game comprising a single deck of cards with the cards having quotations or verses or portions of verses thereon—with the fragments of verses or quotations being distributed among related cards, say of a given suit. Thus, matching the cards of a suit in a player's hand also pieces together the phrase or verse. Such an apparatus and method is far removed from the game of the present invention.

SUMMARY OF THE INVENTION

In keeping with the aforesaid objects of the invention and others which may become apparent, the present invention provides a card game wherein the cards have on them inscribed indicia. The cards are organized and grouped into decks each containing cards of similar purpose and similar kinds of inscriptions. Some decks of cards are distributed to players for play in the game while other decks contain cards held and used only by a person acting as the director of the game. In comparison to player-distributed cards, director's tool decks include at least one deck, respectively of "who" cards, "where" cards and "how" cards.

Player-distribution decks have cards related to each other in that the cards of a given deck will bear inscriptions derived from either a common source or a common subject matter.

For example, a given common-source deck of player-distribution cards may, for example, but without being limited thereto, have inscriptions which are quotes or lines taken from, for example but without limitation, a well-known comedian, a well-known actor, a well-known criminal defendant, or any other type of celebrity. The inscription source need not be a person, it could, for example, without limitation be a well-known artistic, literary, artistic, literary, performance or broadcast work, such as, but without limitation, books, novels, plays, television shows, videos, films, or any other source likely to be known to game players. The term well-known, as used here, refers to that material or those persons which game players are likely to know or recognize.

In contrast to inscriptions derived from a source, such as a given person who is a celebrity, inscriptions may be derived from a common subject matter. Thus, subject-matter card decks may comprise inscriptions taken from, for example, without limitation, lines of well-known comedians (the subject matter would thus be comedians generally or comedic lines generally, and not a given individual comedian). As a further example of subject-matter card decks, the subject matter could be inscriptions taken from highway signs, such as "curves ahead" or "merging traffic".

The inscription sources of the plurality of decks of cards of the present invention may be phrases, taken from a given source, such as a current or relatively recent movie likely to be well known by most players of the game. Potential sources of card inscriptions also may comprise selections from the group consisting of plays, books; short stories; novels; works of art fixed in any medium; literary works fixed in any medium; theatrical works fixed in any medium; musical works fixed in any medium; performance works fixed in any medium; films; broadcast media shows; soap operas; situation comedies; science fiction stories; dramas; romances; westerns; thrillers; horror stories; comedies; farces; action adventures; and fantasies.

An inscription on a card comprises anything any person could say, such as, without being limited thereto, an inscription could be a single work, or a phrase, or a sentence. An inscription could be a plurality or an aggregation of sentences. Or, an inscription could be an exclamation, a declaration, or a question, or any part or portion of written language, including punctuation mark or marks.

The inscriptions on cards comprise a dialog or story line which grows longer with each played card. The inscription on a card being played represents an attempt, by the player, to add to the dangling end of the dialog already on the playing table. The dialog evolves as the game is played, thereby generating a plot or story line on the playing table by virtue of the cards which have already been sequentially played.

As further examples, without limitation the inscription sources of the decks of cards for player distribution may further be derived from current or recent films, movies, television productions or other productions of a theatrical, dramatic or comedic or other entertainment nature, and which are likely to be known.

Also as examples without limitation, the sources of inscription on decks of cards for player distribution may also be derived from the teaching of subject matter in any discipline or field of knowledge, such as, but without limitation, art, history, music, geography, science, mathematics and the like.

As further examples, without limitation, the inscription sources of decks of cards for player distribution may also be derived from whimsical, out-of-context phrases not based upon or abstracted from any particular work of art, written work, screen play or the like. For example, a deck cards for which the inscriptions comprise quotes from famous United States Presidents, or one particular United States President, may be provided. Other examples of whimsical or otherwise out of context sources may include, but without limitation, inscriptions comprising quotations from well known sports celebrities, religious figures, film stars, political figures, and any other well known celebrity.

The player-distributed cards are mixed and matched creatively by players taking turns so as to produce a script comprising an amusing and enlightening scenario or story line for a hypothetical dramatic or comedic presentation. "Playing" a card means placing the card down on the game board, face up so that the phrase inscribed on the card is viewable by all the players.

The director has at least one deck of "who" cards, a deck of "how" cards and a deck of "where" cards. The "who", "how" and "where" cards are not playing cards for distribution to players, but rather, permit the director to randomly select a card from the "who", "how" and "where" decks so as to set the general scenario to be developed. Use of the "who", "how" and "where" decks of cards by the director is a matter of selection, because the game of the present invention also provides "who", "how" and "where" lists for the director to use.

The "who", "how" and "where" lists generally provide the same kind of "who", "how" and "where" information as the "who", "how" and "where" cards, but use of the lists produces deliberately director-selected scenario parameters of "who", "how" and "where" whereas, if the director selects cards from the "who", "how" and "where" deck, the selection of "who", "how" and "where" feature of the scenario will be random.

In addition to selecting use of "who", "how" and "where" cards or lists, the director may choose to ignore both cards and lists and instead may use his/her own imagination to create the "who", "how" and "where" particulars otherwise available from the cards or lists.

Players elect one person to be the director. The director may be the same person throughout all rounds of the game, or the director position may rotate among the players, according to the election of the player group. The director is not only a director of the game, but also functions in the manner of a theatrical or film director, to judge the appropriateness of cards played.

The director may participate in game play, in addition to performing services as a director. Whether or not the director will participate in game play is determined by the group of players at the onset of the game by vote or mutual agreement. The director shuffles card decks and randomly distributes cards to the game players.

The director selects the types of decks of cards thus determining the type of cards to be distributed. The total number of cards to be distributed, however, may be determined by the group by mutual agreement at the outset of the game where the director will not be participating in the play of the game. However, if the director is to participate in the play of the game, then the director may select the number of cards to be distributed to each player. Preferably the director will participate in the play of the game.

Anywhere from 4 to 14 cards in total may be distributed to each player in each round, but the preferable total number of cards distributed to each player is seven. The number of cards distributed to each player remains the same from round to round.

The director not only selects the individual card decks for distribution to players but also selects the scenario to be developed in the play of the game by selecting cards at random respective decks of "who" "how" and "where" cards, or deliberately by selecting "who" "how" and "where" information from lists.

In the play of the game, players take turns playing their respective cards, one card at a time unless otherwise specified by the game rules, more particularly pointed out in detail below, as where wild cards may be used.

The played cards are placed with the inscription face-up for all players to see on a game board provided by the present invention. The game board has sequentially numbered spaces thereon so as to enable the players to conveniently position played cards visibly and in sequence. The result of the sequential playing of cards is the development of the hypothetical script comprising a scenario or story line by successive additions to its dangling end upon the game board. The game board also has spaces marked "who", "how" and "where" on which the director places respective "who", "how" and "where" cards face up to announce the information inscribed thereon to the players. If the director has selected "who", "how" and "where" information from lists instead of randomly drawing cards, the director writes the respective "who", "how" and "where" information on slips of paper and places the slips in the respective "who", "how" and "where" spaces on the game board.

The hypothetical script may be, according to the user's imagination, a script for a movie scene (i.e., a screenplay), or a script for a scene of a hypothetical theatrical or television production, created during the play of the game and for the delight and entertainment of all the players.

Within the imagination of the user, the script to be created by playing the game of the present invention could comprise any creative work, such as, but without being limited to, a literary work, such as a screen play, novel, short story, or even a comic book.

By selecting "who" "how" and "where" information either by randomly drawing "who", "how" and "where" cards or by selecting from a list, the director selects a type of scenario to be developed in the play of the game from the source group consisting of literary works, screen plays, plays, books; short stories; novels; works of art fixed in any medium; literary works fixed in any medium; theatrical works fixed in any medium; musical works fixed in any medium; performance works fixed in any medium; films; broadcast media shows; soap operas; situation comedies; science fiction stories; dramas; romances; westerns; thrillers; horror stories; comedies; farces; action adventures; and fantasies.

The director informs the players of his/her selection of scenario by placing "who" "how" and "where" cards upon the game board in the spaces respectively provided for them on the game board. If the director has selected the scenario from lists, the director writes the "who" "how" and "where" information on slips of blank paper and similarly places the slips on the game board so that they players can view them.

In addition to the plurality of card decks for distribution to players and the director's respective "who", "how" and "where" card decks, the present invention has at least one deck of Wild Cards for distribution to players and at least one deck of Interjection Cards for distribution to players.

Wild Cards contain instructions permitting a player holding one to engage in plays otherwise prohibited by the rules. For example, if the inscription on a Wild Card so provides, the player using it may play more than one of his/her cards at a time when the Wild Card is used in that player's ordinary turn.

Alternatively, a Wild Card may permit a player to play one or more of his/her cards by placing the cards at some chosen point on the game board other than the dangling end of the dialog being developed as the game is played. Placing the played card(s) at the dangling end of the dialog is called for by the Game's normal rules.

Wild card inscriptions may be such phrases as "play two cards" or "play three cards" or "play any number of cards in your hand" or "play a card anywhere in the dialog" or "add a card at any point your choose" or "add as many cards in your hand at any place you choose". Unused wild cards and/or unused interject cards remaining in a player's hand at the end of a round are assigned a 5-point point value.

Interjection Cards, like Wild Cards, also permit a player holding them to vary the normal rules of game play. An interjection card, when played, allows the holder playing it to interject the play of a selected card in the holder's hand at any point in time during the play selected by the holder.

In addition to the types of card decks described above, yet another kind of deck useably by a player during play is a deck of blank cards creatively filled in by a player, comprising a personal deck of cards.

Further, the director is also provided with cut cards, for the director's use in overruling a player's attempted play of a given card.

All cards used for player distribution have point values from 1 to 5 determined by the individual card's difficulty of use, with a 5-point value representing the easiest card to use because of the nature of the dialog phrase inscribed on it, and with a 1-point value representing a card which is deemed most difficult to use in play. Decks of personal cards can be brought into play at any time but these cards have no point value unless the group playing has devised and accepted a value determination system.

A round of play may be completed upon the happening of the first instance of any player having played all of his/her cards. The winner of the round is the player with the fewest points remaining in his/her hand, the point value for each player being recorded on a tally sheet. Players remove points from their hands as cards bearing point values are played.

A round may end when it is declared finished by the director or, as already stated, a round may end when the first player has played all of his/her cards. If a round ends by director declaration then the player holding the fewest points is declared to have zero points, and that player's point total is subtracted from the respective totals of the other players. The decision whether or not the round ends by director declaration or by the happening of the first play to play all of his/her cards, is in the discretion of the director.

Cards having phrases which are more difficult to fit into a developing story line will have relatively lower point values so as to provide a smaller penalty for failing to play the more difficult phrase cards. On the other hand, the easier-to-use phrase cards will have higher point values. Thus, if a player fails or refuses to use a phrase which is considered easier to use, that player will be left with a relatively larger number of points in his/her hand at the end of the round—representing a point disadvantage and thus a game disadvantage to such player.

Playing of a round is repeated as desired by the group and the game winner is the player with the lowest aggregate point value on the tally sheet at the conclusion of the number of rounds being desired by the group of players.

If the director is not participating in game play in the round he/she directs, then, preferably, the number of rounds of play will equal the number of players. In this fashion, the person serving as director in a given round is not disadvantaged in game points earned by virtue of failure to participate in a given round.

Not all decks need be used in a given game, and it is the director's use of arbitrary authority which determines which decks of cards will be used in a given game. The director, by arbitrary authority, also selects the number of cards to be distributed to each player in a given round of play and selects whether or not to distribute any wild cards or interject cards, and if so, how many each player will receive.

If, at the onset of the game, the players have decided that the director will participate in game play while directing, then the director will be allowed to determined how many cards will be distributed to each player in each round. But if the director sits out a directed round without participating, then the group of players, at the outset, selects the number of cards to be distributed in a round.

The director does not have authority to distribute differing numbers of cards to different players, and is required to treat all players equally in number of cards distributed.

Turning to the type of information provided on the inscriptions of "who", "how" and "where" director's cards, typical "Who" information concerning what kind of person a scenario will be about—and which information is inscribed on "who" cards and to be inscribed on the director's "who" list may comprise the following, without being limited thereto:

| | | | |
|---|---|---|---|
| Advertising Executive | Construction Worker | Hairdresser | Pizza Maker |
| Airlines Hostess | COP | Homeless Person | Plumber |
| Airplane Pilot | Counselor | Hooker | Politician |
| Ambassador | Cousin | Hot Dog Vendor | Post Office Clerk |
| Anarchist | Criminal | Ice Cream Vendor | Pope |
| Artist | Dancer | In-Law | Priest |
| Athlete | Dentist | Lawyer | Professor |
| Aunt | Diplomat | Lesbian | Psychiatrist |
| Auto Repairman | Dirty Old Man | Lover | Rancher |
| Baker | Dishwasher | Make-up Artist | Reporter |

Typical "How" information concerning what kind of mood or mind-state a scenario will involve—and which information is inscribed on "how" cards and to be inscribed on the director's "how" list may comprise the following, without being limited thereto:

| | | | |
|---|---|---|---|
| Affluent | Depressed | Hopeless | Monotonous |
| Afraid | Despairing | Hyperactive | Morbid |
| Angry | Diligent | Inept | Noisy |
| Undisciplined | Annoyed | Disgusted | Infatuated |
| Oblivious | Unreasonable | Anti-Social | Disturbed |
| Injured | Intelligent | Organized | Worried |
| Apathetic | Doubtful | Irrational | Paternal |

Typical "Where" information concerning what kind of location a scenario will involve—and which information is inscribed on "where" cards and to be inscribed on the director's "where" list may comprise the following, without being limited thereto:

| | | | |
|---|---|---|---|
| Alcoholics Anonymous Meeting | Corner | Hometown | Playground |
| Accident Scene | Court | Hospital | Police Precinct |
| Airplane | Cruise Ship | Hotel Room | Post Office |
| Amusement Park | Department Store | Ice Cream Parlor | Radio Station |
| Apartment | Desert | Indian Restaurant | Rifle Range |
| Audition | Diner | Jail | River |
| Bakery | Disney World | Laundromat | Roller Skating Rink |
| Bank | Doctor's Office | Library | Sea World |
| Bar | Elementary School | Locker Room | Shopping Mall |

The director of the game has arbitrary authority to decide whether players are to receive Wild Card(s) and Interject Card(s). The director also decides the number of such cards dealt to game players. All players get the same number of interject cards and/or wild cards, if any are distributed per instructions of the director.

A goal of the game is to provide amusement and instruction to the players in acting, writing, creating and self-confidence, with such skill development having possible expression in acting, teaching, writing, public speaking, and like activities requiring creativity, imagination and general artistic ability.

Playing the game results in the group of players collectively generating scripts, or dialogs, of all kinds. The played inscriptions of the player-distributed cards, when played, comprise a sequence of inscriptions which comprise the script or dialog. The script or dialog embodies a scenario, or story line which the players, together with the director, have developed during play of the game. The play of the game has been guided by the "who", "how" and "where" elements set forth at the outset of the game by the director.

Dialogs thus developed may be, but are not limited to drama, comedy, science fiction, horror, action, romance. Players are rewarded by approval and recognition from the player group for the creative and intelligent use of the cards played.

The director of the game determines, arbitrarily, which cards may be successfully played. A card play may be prohibited by the director if, in the director's view, the phrase on the card sought to be played is inappropriate for the place in the string of already-developed game dialog where the player seeks to place it.

To prohibit the play of a card, the director uses a "Cut" card having the word "cut" inscribed thereon by placing the "Cut" card face up upon the game board.

Thus, the playing of a given card by a given player does not automatically comprise a successful card play because the game's director has arbitrary authority to reject the attempted card play on any ground at all—or no ground. Chiefly, the director is expected to reject the play of a card on grounds of the phrase on the attempted card play being in some way inappropriate to the immediately preceding card.

However, the arbitrary authority of the director may be challenged by the player, who has the right to attempt to contravene the arbitrary authority of the director's card rejection with an appeal—but the player appealing the director's unfavorable ruling must appeal to the group of players, who act as jury and as ultimate arbiter of the playability of the card in question.

The player appealing an unfavorable ruling by the director made by virtue of the director's arbitrary authority must make his/her appeal in some form to the jury of other players. The jury then votes. To win an appeal, an appealing player must be the beneficiary of a jury vote in which more than 50% of the jury votes in favor of the appealing player. If the jury fails to vote favorably with the appealing player, then the player-appellant loses the appeal, the arbitrary authority of the director in that instance is upheld, and the appealing player loses his/her chance to play a card, and the opportunity to play a card passes in turn to the next player.

Players of the game strive to use up all the cards in their possession as quickly as possible in ways that create spontaneous, humorous, dramatic and exciting scenes.

For each round of play the director interacts with the game play at such times as the director selects in order to influence the game's action. The director role may be assumed by one person for the entire game or the director role may preferably be rotated among the players.

Each card's phrase comprises a bit of information, the meaning and significance of which can be ainusingly and creatively combined with other out-of-context phrases to produce a unique newly-created whole story comprised of player-selected phrases on cards which have been played.

The cards, which are played by a player removing such cards one at a time from his/her hand and placing them down upon a playing table comprise the amusing story line of the given game being played.

In one embodiment of the present invention a computer, with a monitor, printer, input means and storage means, and a scanner are used to scan the sequence of played cards comprising the story of the instant game into a computer for optical character recognition generation of a text file, thereby preserving in computer-storable form the story created by the game in play. The text file can be displayed on the monitor, printed, edited and transferred to other computers by conventional means.

The director, if he/she is not a player, cannot decide the number of cards to be used because so allowing would provide the director with an opportunity to manipulate the points achieved by all the players.

An object of the game in each round is for each player to play his/her cards, in one-at-a-time, sequential, turn-taking fashion. "Playing" a card means placing the card down on the game board, face up so that the phrase inscribed on the card is viewable by all the players.

A competitive object of the game, which is played in rounds, is for the winning player to arrive at the end of the game with the smallest number of points. A round may be won, and thus concluded, when the first player has played all the cards dealt to him/her. Alternatively, the director may declare the round concluded at any point in the game, and not necessarily when the first player has played all cards in his/her hand. The director may thus terminate a round of play before any player has played, or used up all cards in his/her hand, or, alternatively, the director may permit the round to continue past the point where the first player has an empty hand by virtue of having played all cards.

In the event the director is not playing in a given round, and the director terminates a round of play before the first player has used up all the cards in hand, then, in order to prevent the director from gaining game point advantage, a special scoring scheme is provided. Where the director is not playing in a round, and terminates it before the first player has played all cards, then, upon termination of the round the player with the smallest number of points is deemed to have zero points, and all other players substract the number of actual points held by the person lowest-point player from the pint values in their own respective hands.

Game Points are assigned to each inscription on each card to be distributed to each player. The more difficult a particular inscription is for a player to play, the smaller the number of points assigned thereto. Point values for cards may be assigned from values between one point for the most difficult inscriptions to play to five points, for the easiest inscriptions to play.

The developing plot or story line evolves as a result of the game dialog created, to the amusement and enlightenment of the players.

Player amusement and enthusiasm arise from the fact that each player has the power to creatively amuse the entire group by selecting a phrase on a card in his/her hand which will cause amusement, amazement, laughter, or enlightenment, or all of the foregoing to the group of players, thereby bringing recognition, and thus psychic reward to the player responsible for the latest addition to the string of played-card phrases comprising the growing story line of each round of play.

Depending on the card deck selected, the purpose of any game may be to instruct or to entertain, or both simultaneously. In the case where a card deck contains phrases form a recent or current well-known movie, for example, the amusement may arise from the juxtaposition of dialog phrases from the movie in a fashion unanticipated by anyone—and thus being comical and entertaining by virtue of juxtaposition of the familiar within the framework of otherwise well-known movie characters.

In the alternative, the decks of cards may be directed to knowledge within a given discipline, thus challenging the knowledge of the players so as to combine the phrases on the cards dealt in a way which is relevant, amusing or otherwise interesting and acceptable to the group of players.

Further, the game of the present invention forces players to think creatively because a player's choice of phrase cannot be thoughtless. If the player's choice of phrase is considered inappropriate by the director (i.e., the game's director) then the director is empowered with authority to arbitrarily reject the player's choice of card being played.

Such director play rejection operates as a slight personal rejection to the player, who will wish to avoid such rejection. In avoiding rejection, creativity in the playing of card phrases is thereby stimulated.

And, the truly flamboyant player may wish to deliberately incur a risk of director rejection so as to challenge the director by appealing the rejection to the ultimate authority of a vote by the players—who, as a group are empowered as a jury to overrule the rejection decision of the director by a majority vote. The flamboyant risk-taking player must explain his/her reason for wishing to play a given card at a given point in the round, and must do so convincingly or risk the jury vote to uphold the director's decision, thus doubly confirming the rejection of the flamboyant player.

But the flamboyant player can call forth presentational and emoting skills so as to color the contested phrase with inflection and emotional and even substantial significance not anticipated by the director or any of the other players—in an effort to thereby effectively color, enhance, modify or even change the meaning of the contested phrase in the course of the flamboyant appellant's effort to get the jury to overrule the director judge.

The Best Mode for playing the game is to play it with multiple decks of cards.

In keeping with the foregoing an alternate, non-preferred embodiment of the game of the present invention comprises a computer and an scanner, for capture storage of the developed script in a given round, and the producing of a text file therefrom. The text files of scenarios may thus be saved for use at a later time or for resumption of play at a later time. The text files can be mixed and/or matched, in whole or in part by the same or different players in yet another alternate embodiment of the present invention.

In an alternate non-preferred embodiment, a timer may be used by the director to put a time limit on the players for playing a card.

OBJECTS OF THE INVENTION

To overcome fie disadvantages of the prior art, it is an object of the present invention to teach script-writing skills to the user, who is a game player, and to develop ingenuity, spontaneity, flamboyance and self-confidence in the thinking, creating and writing abilities of the user.

A further object of the present invention is to teach thinking skills relating to acting, performing, teaching and public speaking, and, similarly, to develop ingenuity, spontaneity, flamboyance and self-confidence in the acting, teaching, and public speaking skills of the user.

A further object of the present invention is to teach quick-response skills relating to unexpected and unpredictable human interaction situations, as such unpredictability relates to acting, performing, teaching and public speaking, and, similarly, to develop ingenuity, spontaneity, flamboyance and self-confidence in the acting, teaching, and public speaking skills of the user.

A further object of the invention is to amuse the players.

Yet another object of the invention is to teach or familiarize players with current subject matter and personalities in the arts, theater, literature, films, and performance works generally.

Yet another object of the invention is to stimulate and elicit acts of mental agility among the players.

Yet another object of the invention is to elicit creative thinking on the part of the players.

Yet a further object of the invention is to link game of the present invention to the use of a computer for synergistic entertainment and teaching utility.

Still a further object of the invention is to teach players how to interact with other players when challenged by the director.

Yet a further object of the invention is to improve over the disadvantages of the prior art.

BRIEF DESCRIPTION OF THE DRAWINGS

The invention can best be understood in conjunction with the drawings, as follows.

DETAILED DESCRIPTION OF THE DRAWINGS

Figure 1:
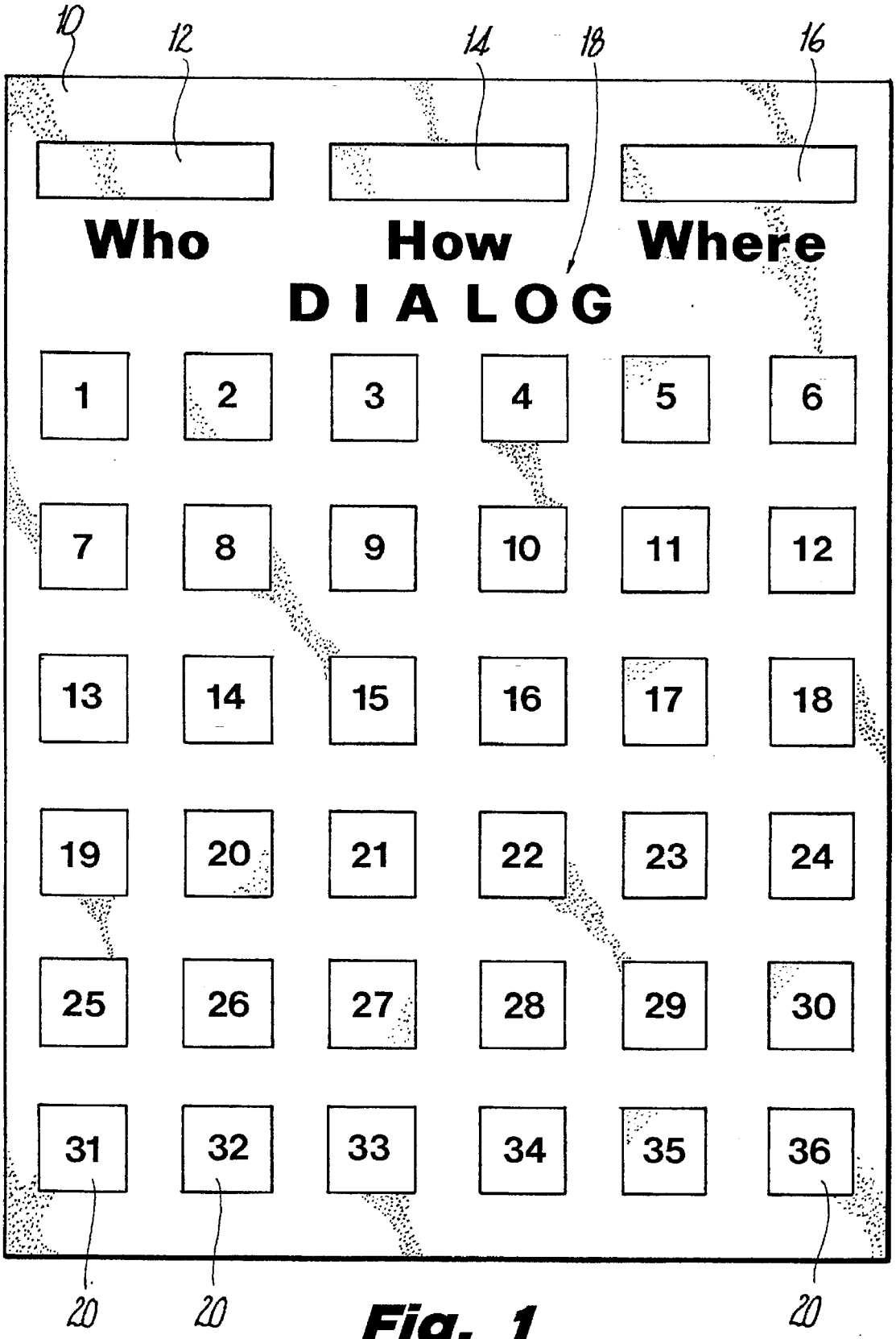
FIG. 1 shows a game board having boxes for convenient positioning of "who", "how" and "where" information as well as numbered squares for the convenient positioning of dialog cards.

FIG. 1 shows a game board 10 having indicia printed thereon showing a convenient location for the director to place a "who" card 12, a "how" card 14 and a "where" card 16. The word "Dialog" 18 is printed as are geometrically positioned and spaced apart squares 20, having sequential numerals printed therein for the convenient positioning of dialog card during the play of the game.

Figure 2:
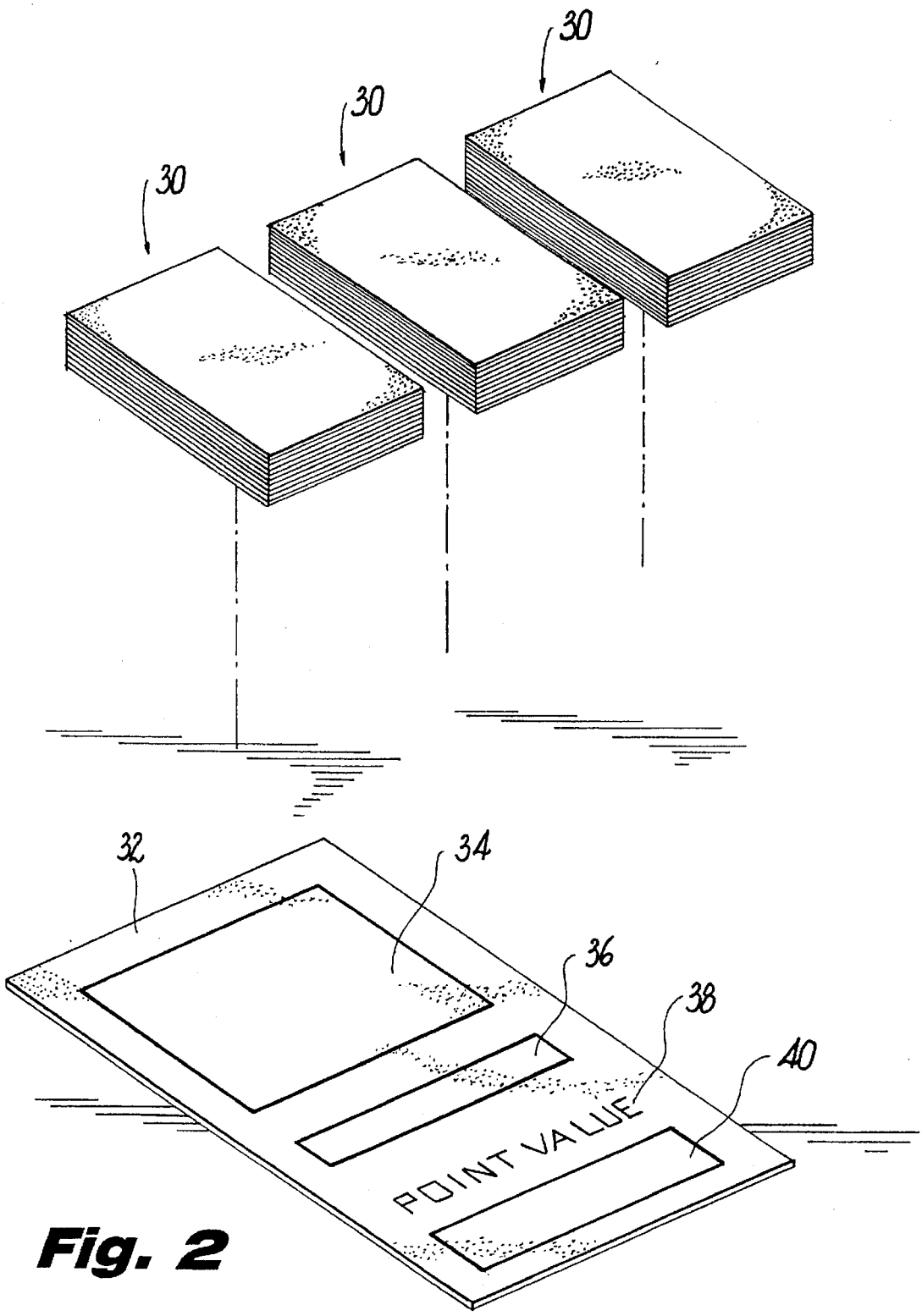
FIG. 2 shows a plurality of card decks used in the game of the present invention, and also shows the face of a typical card found in a deck.

FIG. 2 shows a plurality of card decks 30. Decks 30 may be decks of player cards, and each deck 30 will be distinguished from other such decks by the source of the inscription on the cards. For example, one deck 30 may contain quotations from, for example, a well-known celebrity while another deck 30 may contain quotations from a well-known actor, and yet another deck 30 may contain quotations from a well known author, a specific well-known literary work, such as a book, play, film or TV show, and so forth without being limited to the examples given here.

Also shown in FIG. 2 is the face of a typical card 32 comprising a part of decks 30. Card 32 has a space 34 for inscription of an individual quotation from a source, a space 36 for inscription of the source, such as for example, the name of a celebrity. Card 32 is further provided with the printed inscription "point value" in proximity to box 40 for the printing of an individual numerical point value therein.

Figure 3:
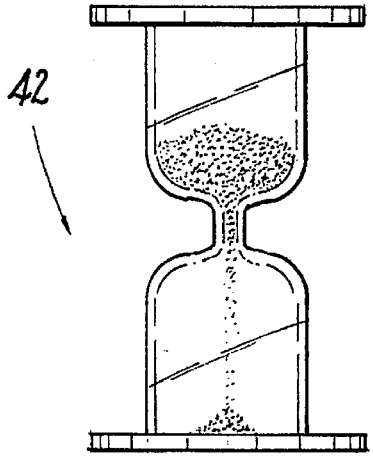
FIG. 3 shows a timer which may be employed in the play of the game of the present invention.

FIG. 3 shows a timing device 42 for use with the present invention. Timing device 42 is an hour-glass-type of timer, but any suitable timing device may be substituted therefore without departing from the scope or spirit of the current invention.

Figure 4:
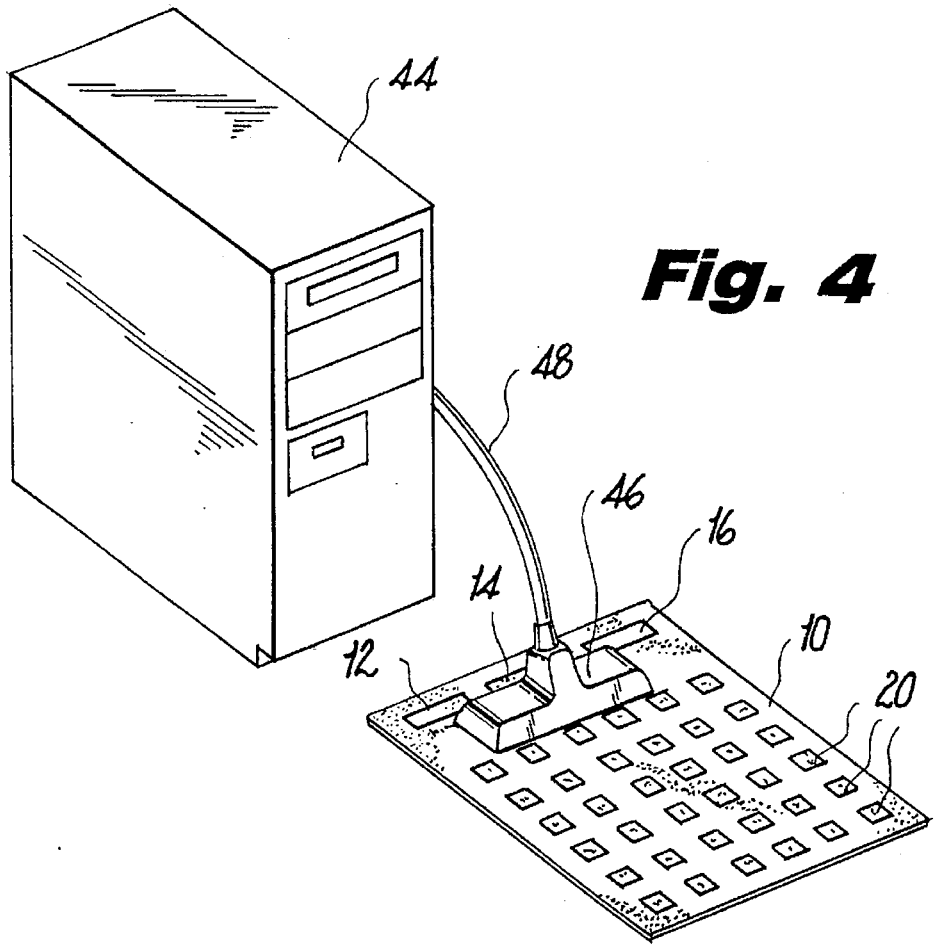
FIG. 4 shows a computer having a scanner for scanning in developed stories, for the development of computer text files containing the stories and the storage of the text files.

4. FIG. 4 shows computer 44 and scanner 46 connected to each other by cable 48 for scanning game board 10 having geometrically positioned and spaced apart squares 20 and locations 12, 14, and 16, for scanning a completed story line into the computer in a digitally encoded form, the digitally encoded scanned information is then processed by suitable optical character recognition software resulting in a computer text file. The resulting text file is stored in nonvolatile memory, such as on a hard disk or a floppy disk for later use in developing other stories, for combining with other scanned-in stories for further and greater learning and amusement.

Further modifications may be made to the present invention without departing from its scope, as noted in the appended claims.

I claim:

1. A method for amusing a group of players, comprising game rules, a game board and at least one deck of cards comprising the steps of:

a. selecting a director;

b. selecting hypothetical story line components;

c. explaining to the players the rules for play;

d. selecting for distribution to players at least one card deck containing cards with inscriptions, the card inscriptions within the at least one deck being related to each other within the at least one deck, the cards also having point values thereon;

e. shuffling the selected at least one deck of cards; and f. selecting a number of cards for distribution to each player; and g. distributing the selected number of cards in equal number to each player from the at least one shuffled deck; and h. determining the winner of the round by determining the player with the fewest points remaining in his/her hand;

i. recording on a tally sheet the end-of-round point value total remaining in each player's hand;

k. repeating the playing of a round as desired by the group; and l. determining the game winner by determining by the player with the lowest aggregate point value on the tally sheet at the conclusion of the number of rounds being desired by the group of players.

2. The method of claim 1 wherein further a. the director being permitted to participate in game play; and b. the director selecting a number of cards for player distribution from about 4 cards to about 11 cards; and c. the director distributing the selected number of cards for player distribution to players.

3. The method of claim 2, with a. the game board comprising a plurality of sequentially numbered spaces for convenient placement of played cards thereon so as to facilitate the placement of played cards in a sequence;

b. the game board having spaces respectively marked "who", "how" and "where" for placement thereon of respective "who", "how" and "where" cards;

c. the director selecting a type of story line to be developed in the play of the game from a source group consisting of plays, books; short stories; novels; works of art fixed in any medium; literary works fixed in any medium; theatrical works fixed in any medium; musical works fixed in any medium; performance works fixed in any medium; films; broadcast media shows; soap operas; situation comedies; science fiction stories; dramas; romances; westerns; thrillers; horror stories; comedies; farces; action adventures; and fantasies; and further where d. the director selecting at least one deck of cards with related inscriptions thereon for player distribution, the director shuffling the cards and distributing them randomly in equal selected numbers to the players;

e. the at least one deck of cards further comprising a director's cut card deck, comprised of cut cards, the playing of which cut cards by the director enabling the director to prohibit the playing of any card at any time during the game and by so doing the director exercises arbitrary artistic directorial authority over the story line being developed in a given round of play;

f. the at least one deck of cards further comprising at least one interjection card deck, the interjection card deck comprising a plurality of interjection cards for distribution to players;

g. the director selecting a number of interjection cards to be distributed and distributing same to the players;

h. the at least one deck of cards further comprises at least one wild card deck, the wild card deck comprising a plurality of wild cards for distribution to players;

i. the director selecting a number of wild cards to be distributed and distributing same randomly to the players;

j. the at least one deck of cards further comprising, respectively, at least one "who" card deck, at least one "where" card deck, at least one "how" card deck, respectively inscribed with "who" "where" and "how" story line elements, the cards of the at least one "who" card deck, at least one "where" card deck and at least one "how" card deck being randomly selected by the director to comprise "who" "where" and "how" story line elements, the randomly director-drawn "who" "where" and "how" cards being placed face up on the game board on the game board spaces provided therefor as an announcement to players of the "who" "where" and "how" story line elements of the game to be played.

4. The method of claim 3 wherein further:

a. the story-line element of "who" comprising at least one story character; the element of "where" comprising at least one story time-and-place; and the element of "how" comprising at least one dramatic conflict;

b. within a given at least one deck of cards for player distribution the inscriptions on cards in the deck are related by being derived from sources selected from the group consisting of broadcast media shows; literary works; plays; musical works; works of art; films; video works; movie actors; authors; books; short stories; novels; theatrical works; performance works; soap operas; situation comedies; science fiction stories; dramas; romances; westerns; thrillers; horror stories; comedies; farces; action adventures; fantasies; general script lines; and celebrities; and the rules further providing c. each player having a right to appeal the director's cut decision in regard to the player's play of a given card by means of the appealing player applying to the director to withdraw the cut card, and, if the player's application to restore a played card is denied by the director, the player then having the right to further appeal by applying to the assembled group of players requesting a vote to either affirm or to overturn the director's decision to cut the playing of the disputed card.

5. The method of claim 4, further where a. within a given at least one deck of cards for player distribution the inscriptions on cards in the deck are related by being derived from subject matter disciplines selected from the group consisting of screenplays; action adventures; plays, books; short stories; novels; works of art fixed in any medium; literary works fixed in any medium; theatrical works fixed in any medium; musical works fixed in any medium; performance works fixed in any medium; films; broadcast media shows; soap operas; situation comedies; science fiction stories; dramas; romances; westerns; thrillers; horror stories; comedies; farces; action adventures; and fantasies; and further where b. the director distributing between about 4 and about 14 cards to each player in a round of play;

c. the director using a timing device for limiting the playing time allotted to a player to play a card in a given turn;

d. a round of play being completed upon the happening of the first instance of any player having played all of his/her cards;

e. the director non-randomly selecting "who" "where" and "how" story line elements from lists, the director-selected "who" "where" and "how" story line elements being written by the director on slips of paper, the slips being placed by the director face up on the game board on the game board spaces provided therefor as an announcement to players of the "who" "where" and "how" story line elements of the game to be played.

6. The method of claim 5, the director participating in the play of the game; and a round of play being completed when the director declares the round terminated.

7. The method of claim 5, the group of players selecting the number of cards to be distributed in equal numbers to each player, and the director refraining from participation in the play of the game.

8. The method of claim 5 wherein the number of cards selected for distribution in equal numbers to the players is between about 5 and about 8 cards.

9. The method of claim 5 wherein the number of cards selected for distribution in equal numbers to the players is about 7 cards.

10. The method of claim 5 further comprising a computer having input means, printing means, display means, random access memory means and nonvolatile storage means, and an scanner, for capturing, storing, and producing a text file for storing, printing and/or duplicating or outputting, comprising the steps of:

a. scanning the story line developed in at least one round of game play into the computer;

b. performing optical character recognition upon the scanned image;

c. storing the text file in a suitable electronic storage means; and d. displaying and/or printing the text file.

* * * * *